US006634481B1

(12) United States Patent
Humphrey

(10) Patent No.: US 6,634,481 B1
(45) Date of Patent: Oct. 21, 2003

(54) INVENTORY CONTROL SYSTEM AND METHOD

(75) Inventor: Dallas Humphrey, Long Lake, MN (US)

(73) Assignee: Edina Technical Products, Inc., Plymouth, MN (US)

( * ) Notice: Subject to any disclaimer, the term of this patent is extended or adjusted under 35 U.S.C. 154(b) by 24 days.

(21) Appl. No.: 09/815,565

(22) Filed: Mar. 23, 2001

Related U.S. Application Data

(60) Provisional application No. 60/191,536, filed on Mar. 23, 2000.

(51) Int. Cl.[7] ..... G07F 11/44; A24F 15/00

(52) U.S. Cl. ..... 194/205; 194/214; 40/27.5

(58) Field of Search ..... 194/205, 212, 194/214, 255, 236, 258; 40/27.5; D20/7; 221/137

(56) References Cited

U.S. PATENT DOCUMENTS

| | | | | | |
|---|---|---|---|---|---|
| 869,096 | A | * | 10/1907 | Lloyd et al. | 194/214 |
| 3,822,775 | A | * | 7/1974 | Hall | 194/236 |
| 3,901,366 | A | * | 8/1975 | Schuller et al. | 194/210 |
| 4,679,684 | A | * | 7/1987 | Glaser | 194/350 |
| 4,896,798 | A | * | 1/1990 | Milton | 194/255 |
| D309,634 | S | * | 7/1990 | McDaniel et al. | 194/255 |
| D332,285 | S | * | 1/1993 | Bolen | D20/7 |
| 5,190,133 | A | * | 3/1993 | Bolen | 221/281 |
| 5,290,033 | A | * | 3/1994 | Bittner et al. | 194/206 |
| 5,310,035 | A | * | 5/1994 | Dobransky et al. | 194/206 |
| 5,450,980 | A | * | 9/1995 | Laidlaw | 221/1 |
| 5,573,098 | A | * | 11/1996 | Widmer | 194/212 |
| 5,868,235 | A | * | 2/1999 | Schwarzli | 194/212 |

FOREIGN PATENT DOCUMENTS

| | | | | |
|---|---|---|---|---|
| DE | 3601171 | * | 7/1986 | 453/17 |
| DE | 3630599 | * | 3/1988 | 194/214 |
| WO | WO 88/06771 | * | 9/1988 | 194/205 |

* cited by examiner

*Primary Examiner*—Eileen D. Lillis
*Assistant Examiner*—Paul T. Chin
(74) *Attorney, Agent, or Firm*—Patterson, Thuente, Skaar & Christensen, P.A.

(57) ABSTRACT

An inventory control device and method for dispensing merchandise units. The device includes a structure defining one or more storage compartments, and actuating mechanism, and a metering mechanism. The storage compartment stores a plurality of the merchandise units. The actuating mechanism defines an opening dimensioned and configured to receive a noncurrency token and can be operated only when a token is present in the opening. The metering mechanism releases one merchandise unit when the actuating mechanism is operated. The method includes receiving a request for one of the merchandise units from a person; placing the token in the actuating mechanism opening; operating the actuating mechanism with the token present therein, the metering mechanism releasing the merchandise unit in response to operating the actuating mechanism, and providing the released merchandise unit to the person.

21 Claims, 4 Drawing Sheets

INVENTORY CONTROL SYSTEM AND METHOD

CROSS-REFERENCES TO RELATED APPLICATION

This application claims priority under 35 U.S.C. §119 (e) to, and hereby incorporates by reference, U.S. Provisional Application No. 60/191,536, filed Mar. 23, 2000.

BACKGROUND OF THE INVENTION

1. Field of the Invention

This invention relates to methods and devices for inventory control and, in particular, this invention relates to methods and devices for preventing pilferage of high value inventory items.

2. Background of the Invention

Previously, restricting the sale of restricted items to minors was largely a matter left to merchants. The perceived failure of merchants to require identification verifying that a prospective buyer was of a sufficient age to purchase these items has led to more wide scale enforcement efforts and increased penalties when stores were detected selling these items to minors. Some of these infractions were due to employees failing to check identification in spite of the owners' directives to do so. Moreover, many of these restricted items have high cash values. Because of these high values, employees have increased incentives to either steal these items or to provide them to their friends without receiving payment.

Coin-operated vending machines were formerly widely used to sell cigarettes. However, minors were often easily able to obtain cigarettes from these machines because the machines were frequently in locations where it was not convenient or impossible for proprietors to determine the ages of prospective buyers. Law makers began to view these vending machines with disfavor because they provided a perceived easy method for minors to purchase cigarettes. Over the past few years, the formerly ubiquitous coin-operated cigarette vending machine has all but disappeared. Legislative attempts to control the sale of cigarettes to minors have mandated the disappearance of these vending machines.

In many establishments, cigarettes are now kept in open racks behind a counter or bar to be sold by an individual, such as a cashier. Upon receiving a request to buy cigarettes, the cashier presumably examines the customer's identification to verify that the customer is old enough to purchase cigarettes. If the customer is old enough to purchase cigarettes, the cashier receives the money from the customer, retrieves the cigarettes from the rack, and presents the cigarettes to the customer. This system provides a reasonable level of control to prevent under age customers from purchasing cigarettes. However, this system introduces a new problem for the business.

One problem presented by the above-described system is pilferage of the cigarettes by the cashier. Because a package of cigarettes is a reasonably high-value item, cashiers have an incentive to pilfer merchandise of this nature. Thus, the above-described system has a disadvantage in that it is quite easy for the cashier to merely remove a pack of cigarettes for the cashier's personal use or to give to a friend or preferred customer free of charge. In view of this disadvantage, there is a need for an inventory control system and method for dispensing merchandise, such as cigarettes, which limits access of the cigarettes to under age persons, yet minimizes the likelihood of pilferage.

SUMMARY OF THE INVENTION

The inventory control system and method of the present invention substantially meet the aforementioned needs of the industry. The inventory control system and method require interface between the customer and a person staffing the counter or bar in order that the identification of a person purchasing cigarettes is examined in order to eliminate or minimize the distribution of cigarettes to minors. Beyond that, cigarettes are maintained in a lot dispenser, the dispenser operable only by special tokens, or the like, made particularly to actuate the dispenser. Such a dispenser meets the mandates of laws governing dispensing of cigarettes, and that it is not operable by coins of the realm. Moreover, by being operable only by a special tokens, the dispenser provides for accountability and control of the cigarette package inventory and minimizes the likelihood of pilferage by persons staffing the counter or bar.

It is therefore an object of this invention, to provide a mechanism for dispensing a first unit of merchandise, the mechanism including a token, a reservoir, and actuator, and a dispensing unit. The token may include a noncurrency configuration. The reservoir stores unsold merchandise units. The actuator defines an opening, the opening configured to except the token and is operated by being rotated with a token is inserted in the actuator opening. The dispensing unit is in mechanical or electrical communication with the actuator and dispenses a single merchandise unit when the actuator is operated.

A further object provides a method of dispensing a unit of merchandise using a machine. The machine may include a structure defining a storage compartment, and actuating mechanism, and a metering mechanism. The structure may be configured to store a plurality of the merchandise units. The actuating mechanism may define an opening, the opening dimensioned and configured to except a noncurrency token. The actuating mechanism maybe operable only plan the token is present in the opening of the actuating mechanism. The metering mechanism is operated by the actuating mechanism and may be configured to dispense one of the merchandise units when operated by the actuating mechanism. The method includes 1) receiving a request for one of the merchandise units; 2) placing the token in the actuating mechanism opening; 3) operating the actuating mechanism with a token present therein, the metering mechanism releasing the merchandise unit in response to operating the actuating mechanism; and 4) providing the merchandise unit to a customer.

Additional objects, advantages, and features of various embodiments of the invention will be set forth in part in the description which follows, and in part will become apparent to those skilled in the art upon examination of the following or may be learned by practice of the invention. The objects and advantages of various embodiments of the invention may be realized and attained by means of the instrumentalities and combinations particularly pointed out in the appended claims.

It is understood that the above-described figures are only illustrative of the present invention and are not contemplated to limit the scope thereof.

DETAILED DESCRIPTION OF THE INVENTION/DRAWINGS

References to such relative terms as front and back, right and left, top and bottom, upper and lower, horizontal and vertical, are intended for convenience of description and are not intended to limit the present invention or its components to any one positional or spatial orientation. All dimensions of the components in the attached figures may vary with a potential design and the intended use of an embodiment of the invention without departing from the scope of the invention.

Each of the additional features and methods disclosed herein may be utilized separately or in conjunction with other features and methods to provide improved dispensing devices and methods for making and using the same. Representative examples of the teachings of the present invention, which examples utilize many of these additional features and methods in conjunction, will now be described in detail with reference to the drawings. This detailed description is merely intended to teach a person of skill in the art further details for practicing preferred aspects of the present teachings and is not intended to limit the scope of the invention. Therefore, combinations of features and methods disclosed in the following detailed description may not be necessary to practice the invention in the broadest sense, and are instead taught merely to particularly describe representative and preferred embodiments of the invention.

Figure 1:
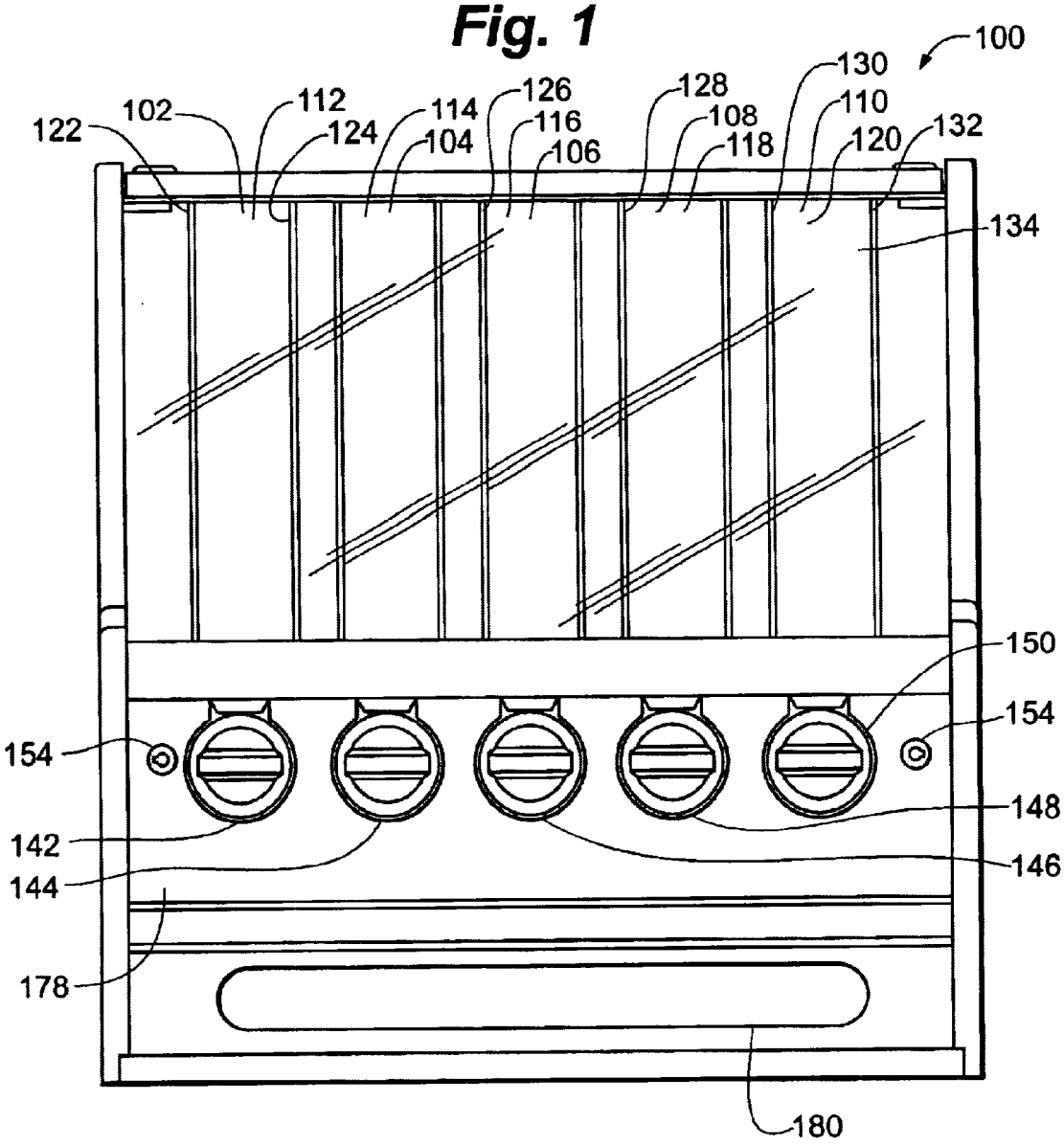
FIG. 1 is a front view of one embodiment of the present inventory control device.
Figure 2:
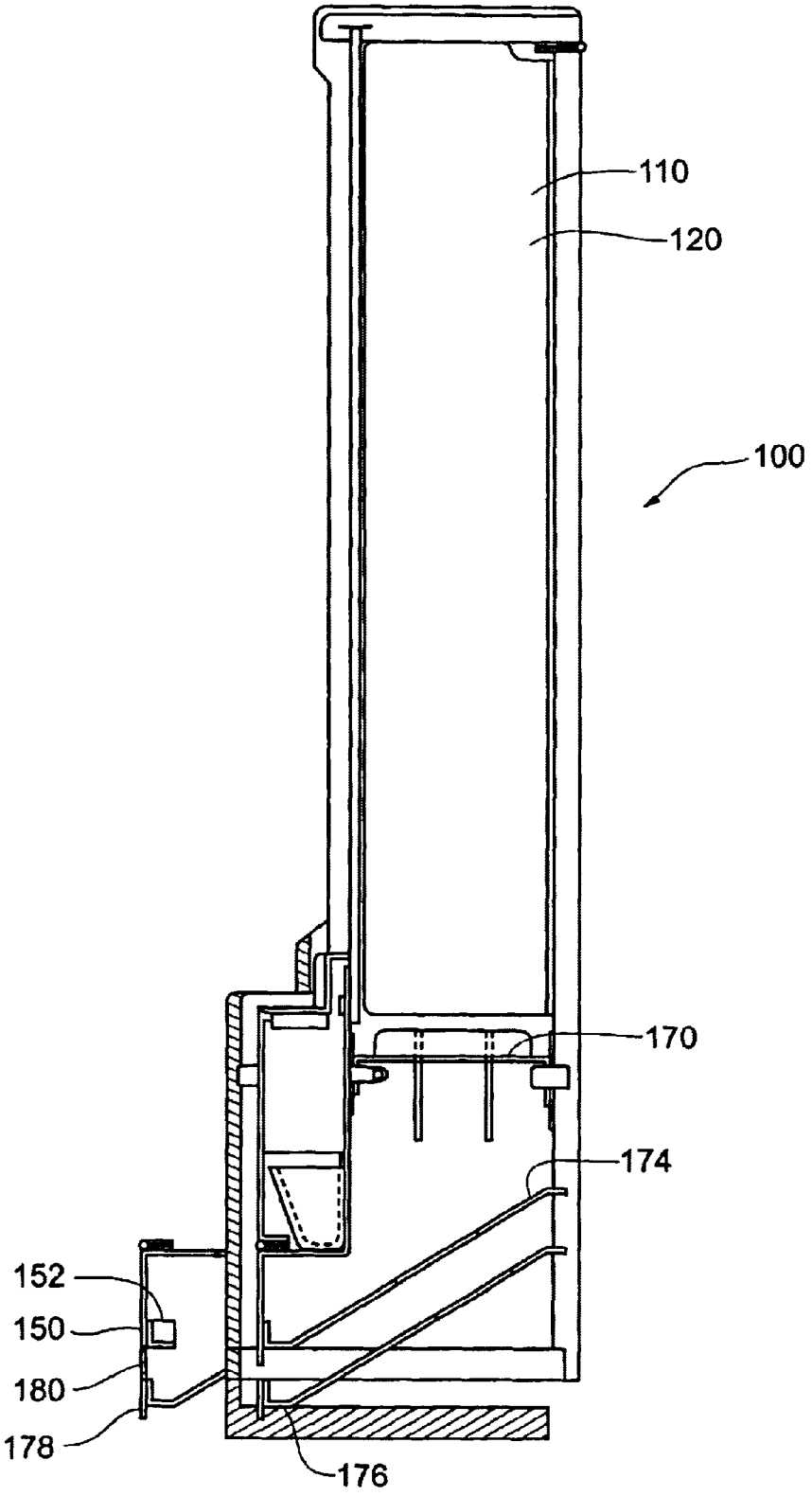
FIG. 2 is a cut away side view of the device of FIG. 1.

Referring to FIGS. 1 and 2, one embodiment of the present invention is a generally upright dispenser 100 having a plurality of substantially parallel individual dispenser units 102, 104, 106, 108, and 110. Obviously, more or fewer dispenser units could be present. Each individual dispenser unit includes a reservoir 112, 114, 116, 118, and 120, respectively defined by partitions 122, 124, 126, 128, 130, and 132. High-value items, such as packs of cigarettes, may be stacked within the reservoirs 112–120 to be dispensed as described below. Each reservoir 112–120 may be contained behind a clear facing cover 134 so that the stock of cigarette packages in each dispenser unit 102-110 is readily viewable. Each individual dispenser unit 102–110 includes a token-operated actuator 142, 144, 146, 148, and 150. Referring particularly to FIG. 2, a compartment 152 is defined behind or below the actuators 142–150. The compartment 152 is accessible only via the locks 154 (FIG. 1).

Again referring to FIG. 2, each dispensing unit 102–110 has a corresponding dispensing mechanism 162, 164, 166, 168, and 170 (only dispensing mechanism 170 shown). Each actuator 142–150 is thus in electrical or mechanical communication (e.g., mechanical linkage, electrical switch and trip) with a corresponding dispensing mechanism 162–170 such that inserting a token 172 into one of the actuators 142–150 causes a corresponding dispensing mechanism 162–170 to release a single package of cigarettes. The cigarette packages are fed to each dispensing mechanism 162–170 by gravity from a corresponding reservoir 112–120. The token 172 is inserted into one of the actuators 142–150. The actuators 142–150 operate only when the token 172 is present (see FIG. 3). Operating the actuators causes the token to rotate and drop into the compartment 152, where the token can be retrieved only when the locks 154 are opened. When operated, the actuators 142–150 cause corresponding dispensing mechanisms to release a single package. Upon being dispensed, a package of cigarettes is ejected or allowed to fall from the reservoir onto an incline 174. The cigarette package then slides to a lower portion 176 of the incline 174, so that it can be accessed by the store attendant via an opening in the front panel 178, such as a slot 180.

Figure 3:
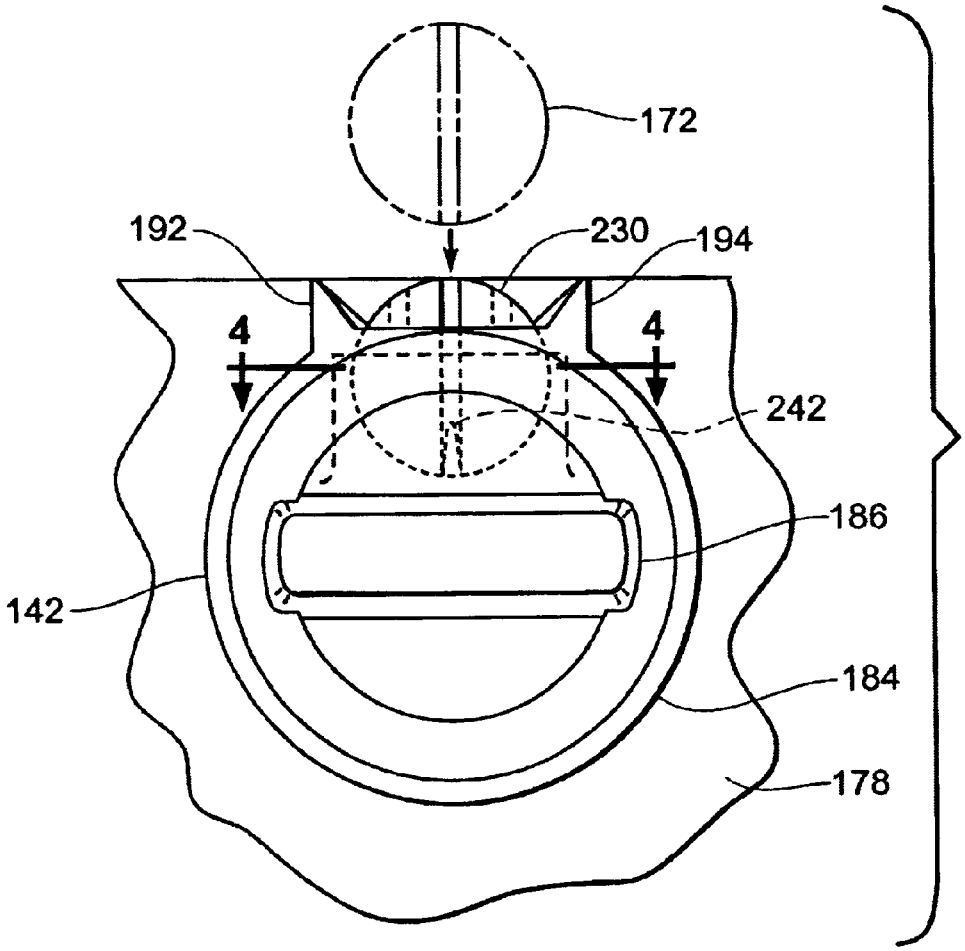
FIG. 3 is a fragmentary view of an exemplary dispensing mechanism of the device of FIG. 1, an exemplary token depicted partially in phantom.
Figure 4:
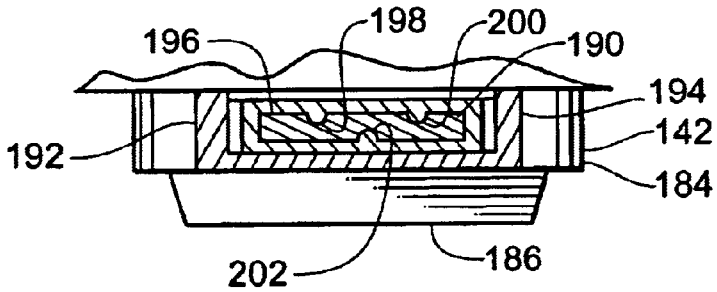
FIG. 4 is a fragmentary plan view of the dispensing mechanism of FIG. 3.
Figure 5:
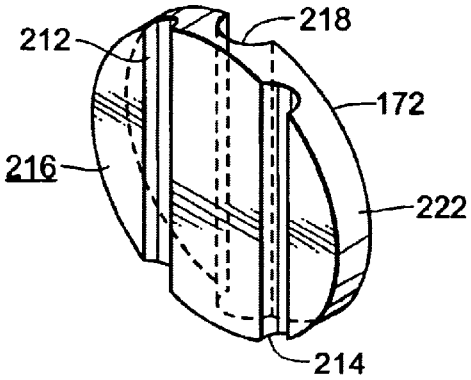
FIG. 5 is a perspective view of a first embodiment of the present token.
Figure 9:
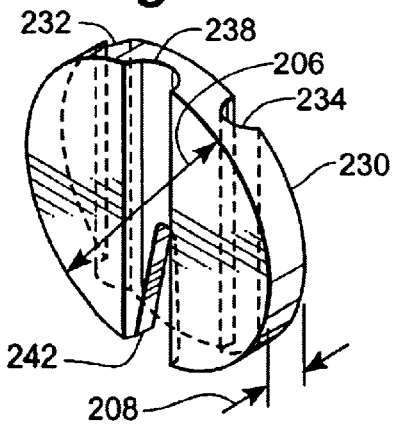
FIG. 9 is a perspective view of a second embodiment of the present token.
Figure 6:
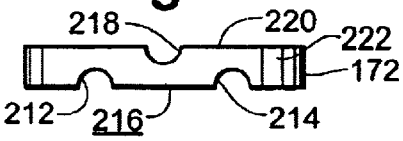
FIG. 6 is a plan view of the token of FIG. 5.
Figure 10:
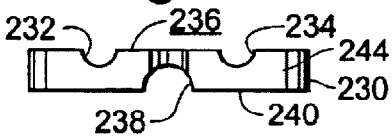
FIG. 10 is a plan view of the token of FIG. 9.
Figure 7:
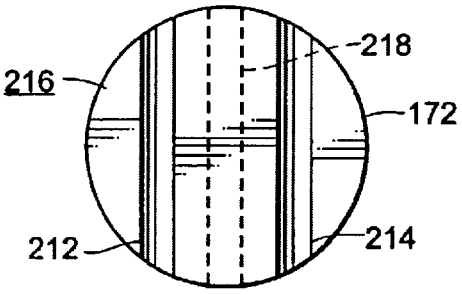
FIG. 7 is a front view of a first side of the token of FIG. 5.
Figure 11:
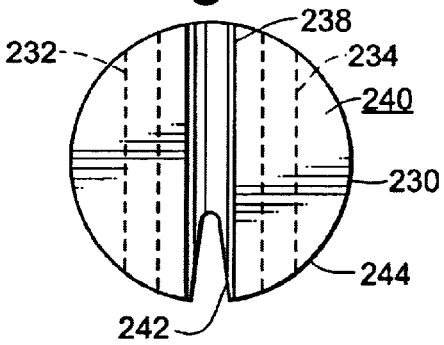
FIG. 11 is a front view of a first side of the token of FIG. 9.
Figure 8:
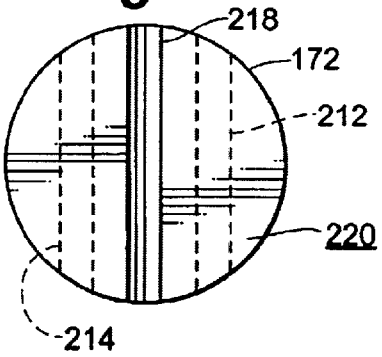
FIG. 8 is a front view of a second side of the token of FIG. 5.
Figure 12:
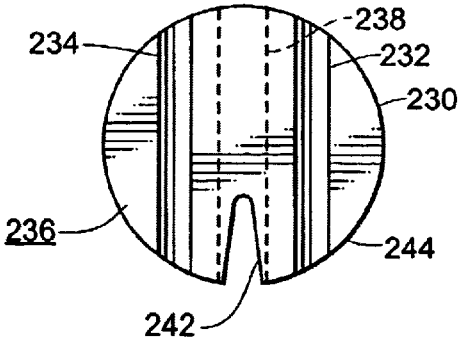
FIG. 12 is a front view of a second side of the token of FIG. 9.

As seen in FIGS. 3 and 4, each actuator 142–150 (only actuator 142 shown) includes a cap member 184 and a gripping element 186. A token slot 190 is defined between guides 192 and 194. The slot 190 is further defined by a rim 196. Ribs 198, 200, and 202 extend from the rim 196.

In this embodiment, the token 172 is distinctive in size and configuration from coins in circulation as currency. A noncurrency token of the present invention is defined herein as having a diameter 206, thickness 208, or noncurrency surface geometry (discussed hereinbelow) which would allow the token 172, but not a coin of currency, to be snugly accommodated in the present actuator slot 190.

As shown in FIGS. 5–8, a first embodiment of the present token 172 is between the size of a quarter and a nickel and may have a plurality of grooves, e.g., 212 and 214 machined, e.g., in parallel, on a first side (face) 216 and at least one groove 218 on a second side (face) 220 thereof The token 172 defines a rim 222. The groove 218 may be extend substantially parallel to the grooves 212 and 214.

Another embodiment of the present token is depicted in FIGS. 9–12 at 230. The token 230 defines a plurality of grooves, e.g., grooves 232 and 234, in a first face 236 and at least one groove 238 in a second face 240. A substantially noncircular edge geometry, such as a V-notch 242, may extend inwardly from a rim 244. The present actuator, when used with a token embodiment, such as token 230, may usually be operated only when the notched portion 242 is inserted as shown in phantom and FIG. 3. The groove pairs 212–214 and 232–234 and the grooves 218 and 238 may be dimensioned and located to accommodate the ribs 198–200 and 202 therein. While the grooves 212, 214, 218, 232, 234, and 238 are depicted in this being generally arcuate, the present grooves may be defined by any number of the cross sectional geometries, e.g., square, triangular. Accordingly, the grooves of the present token 230 must be dimensioned and located so as to accommodate the ribs 198, 200, and 202 in the token slot 190. In this manner, only particular tokens 172, 230, designed for use with the dispenser 100, are capable of being inserted into the present token slot 190.

As will be seen hereinbelow, the present token 172, 230 provides the only means of obtaining a package of cigarettes from the dispenser 100. If differing types of cigarettes are sold at different prices, a separate token embodiment may be used to dispense cigarettes sold at each price. In addition to the embodiments shown and described herein, token embodiments might further differ, e.g., given diameter, thickness, the number and spacing of grooves and/or the presence or absence of noncircular configurations, such as V-notches. The slots in corresponding actuators would then have ribs, or other surfaces, dimensioned and spaced to fit into a particular groove configuration and/or actuators, which can be operated only in the presence of a token with or without a V-notch.

In one exemplary method, the attendant receives a set amount of tokens 172 and/or 230 and an amount of currency, e.g., at the beginning of the attendant's shift. The tokens 172, 230 would be for use in the present dispenser 100 and the currency would be for making change during a purchase. In use, the attendant receives an order for a particular brand of cigarettes and obtains the money therefor (perhaps after examining identification to verify the buyer's age). The attendant then selects one of the present tokens 172, 230 and fits the token into the slot 190 of the actuator corresponding to the desired brand of cigarettes. The attendant then rotates the cap member, e.g., cap member 184, by grasping and rotating the gripping element, e.g., gripping element 186, thereby activating the corresponding dispensing mechanism, releasing the pack of cigarettes from the reservoir, e.g. reservoir 112, and dropping the token 172, 230 into the locked compartment 152. The tokens 172, 230 in the compartment 152 are accessible only when the locks 154 are operated. The key to the locks 154 can be kept by managers and used when tallying the numbers of tokens 172, 230 and cigarettes at the end of the attendant's shift. The released pack of cigarettes falls from the reservoir 112, slides down the incline 174, and is retrieved by the attendant through the slot 180. As discussed above, if cigarettes are being sold at a plurality of prices, a particular token configuration can be used in a corresponding dispenser slot configuration at each price. At the end of the attendant's shift, quantities of cigarette packages and tokens can be tallied to detect whether pilferage has occurred. In this example, the dispenser is not accessible to minors. Moreover, the cigarettes are easily accounted for, because there should be an amount of money present in the till for each token used in the present dispenser. In this way, minors are prevented from utilizing the present dispenser and the opportunity for attendants to pilfer cigarettes is eliminated or greatly reduced.

Because numerous modifications of this invention may be made without departing from the spirit thereof, the scope of the invention is not to be limited to the embodiments illustrated and described. Rather, the scope of the invention is to be determined by the appended claims and their equivalents.

What is claimed is:

1. A mechanism for dispensing units of merchandise, comprising:

a first and second token each with a noncurrency configuration different from the other;

a first reservoir configured for storing a first merchandise unit;

a second reservoir configured for storing a second merchandise unit;

a first actuator configured to accept the first token and further configured to operate only when the first token is disposed in the first actuator;

a second actuator configured to accept the second token and further configured to operate only when the second token is disposed in the second actuator;

a first dispensing unit in operable communication with the first actuator and dispensing the first controlled merchandise unit from the first reservoir when the first actuator is operated; and a second dispensing unit in operable communication with the second actuator and dispensing the second controlled merchandise unit from the second reservoir when the second actuator is operated.

2. The mechanism of claim 1, in which at least one of the first and second tokens includes a noncurrency diameter.

3. The mechanism of claim 1, in which at least one of the first and second tokens includes a noncurrency thickness.

4. The mechanism of claim 1, at least one of the first and second tokens comprising a substantially nonplanar token first surface.

5. The mechanism of claim 4, the at least one of the first and second tokens further comprising a second substantially nonplanar surface.

6. The mechanism of claim 5, in which the first and second surfaces are substantially parallel.

7. The mechanism of claim 5, in which one of the first and second surfaces comprises a groove.

8. The mechanism of claim 5, in which one of the first and second surface comprises a plurality of grooves.

9. The mechanism of claim 8, in which the grooves are substantially parallel.

10. The mechanism of claim 5, at least one of the first and second tokens with a substantially noncircular edge geometry.

11. The mechanism of claim 10, in which the substantially noncircular edge geometry comprises a notch.

12. The mechanism of claim 11, in which the notch is generally V-shaped.

13. The mechanism of claim 1, further comprising structure defining a first compartment disposed to receive the first token when the first token drops from the first actuator when the first actuator is being operated, and a second compartment disposed to receive the second token when the second token drops from the second actuator when the second actuator is being operated.

14. The mechanism of claim 13, the structure comprising a lock.

15. A machine for dispensing controlled merchandise units, comprising:

a structure defining a storage compartment for storing a plurality of the merchandise units;

at least two actuating mechanisms each defining an opening, each of the openings dimensioned and configured to accept a noncurrency token of a different shape configuration from that accepted by at least one of the other openings, the at least two actuating mechanisms operable only when the respective different shaped token is present in the respective opening; and a metering mechanism operated by at least one of the at least two actuating mechanisms, the metering mechanism configured to dispense one of the merchandise units when operated by the respective actuating mechanism.

16. A method of accountably dispensing a units of controlled merchandise using a machine, the machine comprising:

a structure defining a storage compartment for storing a plurality of the merchandise units;

a plurality of actuating mechanisms each defining an opening, at least one of the openings dimensioned and configured to accept a different shaped noncurrency token from at least one of the other openings, each of the plurality of actuating mechanisms operable only when the correctly shaped token is present in the respective opening adapted to receive the correctly shaped token; and at least one metering mechanism operated by the plurality of actuating mechanisms, the metering mechanism configured to dispense one of the merchandise units when operated by at least one of the plurality of actuating mechanisms, the method comprising:

receiving a payment for one of the merchandise units from a person;

exchanging the payment received for a first shaped token taken from a reservoir containing a known number of shaped tokens, wherein at least two of the shaped tokens are shaped differently in a noncurrency configuration with respect to each other;

placing the first shaped token in a first actuating mechanism adapted to only receive the first shaped token;

operating a first actuating mechanism with the first shaped token present therein, the at least one metering mechanism releasing the merchandise unit in response to operating the first actuating mechanism;

providing the merchandise unit to the person; and comparing a total amount of payment received against the total number of tokens removed from the token reservoir.

17. The method of claim 16, in which operating the first actuating mechanism includes rotating the first actuating mechanism.

18. The method of claim 16, in which the first actuating mechanism includes a cap member defining a gripping element and in which operating the first actuating mechanism includes rotating the gripping element.

19. The method of claim 16, in which the machine is located at a place accessible only to an attendant.

20. The method of claim 16, in which the first shaped token is maintained in a cash drawer or cash register until being placed in the first actuating mechanism.

21. A method of controlling the inventory of merchandise units by using a machine, the machine comprising:

a structure defining a storage compartment for storing the merchandise units;

a plurality of actuating mechanisms each defining an opening, at least two of the openings dimensioned and configured to accept a noncurrency token, wherein the noncurrency token accepted by one of the at least two openings is a different shape configuration than the noncurrency token accepted by another of the at least two openings, and wherein each of the actuating mechanisms are operable only when the respective token is present in the opening; and at least one metering mechanism operated by the plurality of actuating mechanisms the at least one metering mechanism configured to dispense one of the merchandise units when operated by the respective actuating mechanism the method comprising:

determining the number of merchandise units present in the storage compartment, each merchandise unit with a first cash value;

providing a plurality of tokens to an attendant, each token with a second cash value and having a noncurrency shape configuration;

providing a cash sum to the attendant;

selling some or all of the merchandise units, each sale including receiving a request for one of the merchandise units from a customer, receiving money from a customer, placing one of the plurality of tokens in the actuating mechanism opening adapted to receive only a token of a predefined noncurrency shape configuration;

operating the actuating mechanism with the correct token present in the actuating mechanism opening, the metering mechanism releasing a unit of merchandise in response, the token dropping into the compartment when the actuating mechanism is operated, and providing the released merchandise to the customer;

counting the number of merchandise units after selling some or all of said merchandise units;

counting the number of tokens in the compartment; and counting the number of tokens not in the compartment.

* * * * *

UNITED STATES PATENT AND TRADEMARK OFFICE

CERTIFICATE OF CORRECTION

PATENT NO. : 6,634,481 B1
DATED : October 21, 2003
INVENTOR(S) : Dallas Humphrey It is certified that error appears in the above-identified patent and that said Letters Patent is hereby corrected as shown below:

Title page,
Item [56], References Cited, FOREIGN PATENT DOCUMENTS, delete “3601171” and insert -- 3501171 --.

Column 2,
Line 14, delete “a”.
Line 20, delete the first occurrence of “and” and insert -- an --.
Line 24, delete “except” and insert -- accept --.
Line 25, delete “with” and insert -- when --.
Line 31, delete “and” and insert -- an --.
Line 35, delete “except” and insert -- accept --.
Line 36, delete “maybe” and insert -- may be --.
Line 36, delete “plan” and insert -- when --.

Column 4,
Line 38, after “thereof” insert -- . --.
Line 39, delete “extend” and insert -- extended --.
Line 53, delete “in this” and insert -- as --.

Column 6,
Line 57, delete “a”.

Column 8,
Line 10, after “mechanisms” and insert -- , --.

Signed and Sealed this

Sixth Day of April, 2004

JON W. DUDAS
*Acting Director of the United States Patent and Trademark Office*